United States Patent [19]

Bess, Sr. et al.

[11] 4,149,956

[45] Apr. 17, 1979

[54] ANODE STRUCTURE

[75] Inventors: James W. Bess, Sr., Painesville, Ohio; Oronzio De Nora, Milan, Italy; Richard E. Loftfield, Chardon, Ohio; Giovanni Trisoglio, Milan, Italy

[73] Assignee: Diamond Shamrock Technologies, S.A., Geneva, Switzerland

[21] Appl. No.: 400,708

[22] Filed: Sep. 26, 1973

Related U.S. Application Data

[63] Continuation-in-part of Ser. No. 836,256, Jun. 25, 1969, abandoned.

[51] Int. Cl.[2] ..... C25B 9/00; C25B 9/02; C25B 9/04

[52] U.S. Cl. ..... 204/284; 204/286; 204/288; 204/289; 204/290 F

[58] Field of Search ..... 204/208, 290 F, 284–288, 204/252, 99, 289

[56] References Cited

U.S. PATENT DOCUMENTS

| | | | |
|---|---|---|---|
| 3,271,289 | 9/1966 | Messner | 204/284 |
| 3,297,561 | 1/1967 | Harrison et al. | 204/284 |
| 3,308,043 | 3/1967 | Loftfield et al. | 204/284 |
| 3,380,908 | 4/1968 | Ono et al. | 204/284 |
| 3,562,008 | 2/1971 | Martinsons | 204/290 F |

*Primary Examiner*—R. L. Andrews
*Attorney, Agent, or Firm*—Hammond & Littell

[57] ABSTRACT

Relates to anodes for electrolytic cells, for the electrolysis of brine solutions, having primary lead-in means of high conducting capacity (copper) for supplying anodic current to the cell from outside the cell and connected to a current supply source, primary conducting means of lower conducting capacity (titanium, or tantalum or alloys thereof) inside the cell, secondary conducting means of lower conducting capacity (titanium, or tantalum or alloys thereof) inside the cell for conducting current to an electrocatalytically active coating carried on a valve metal base, said electrocatalytic coating being capable of catalyzing halogen ion discharge without becoming passivated over long periods of time, said anodes serving to distribute the current in a cascade fashion from the primary lead-ins to the anode face.

8 Claims, 17 Drawing Figures

FIG. 1
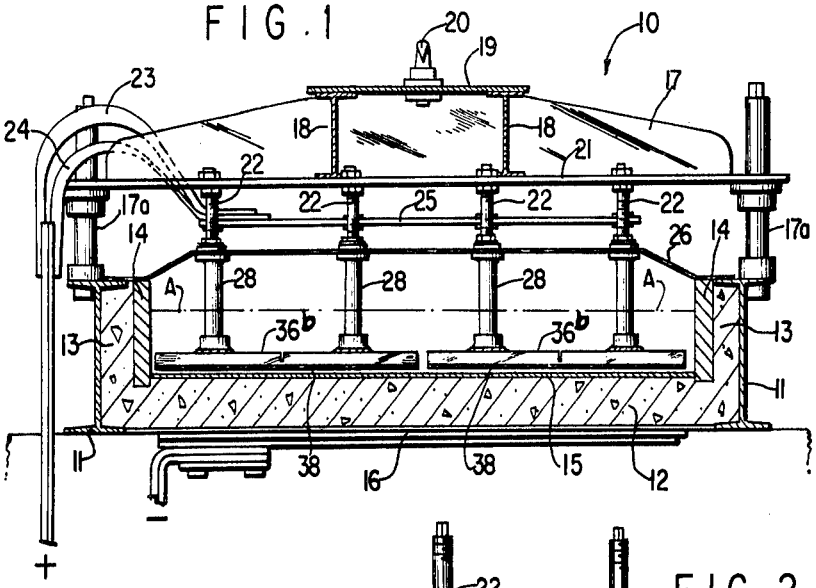
FIG. 2
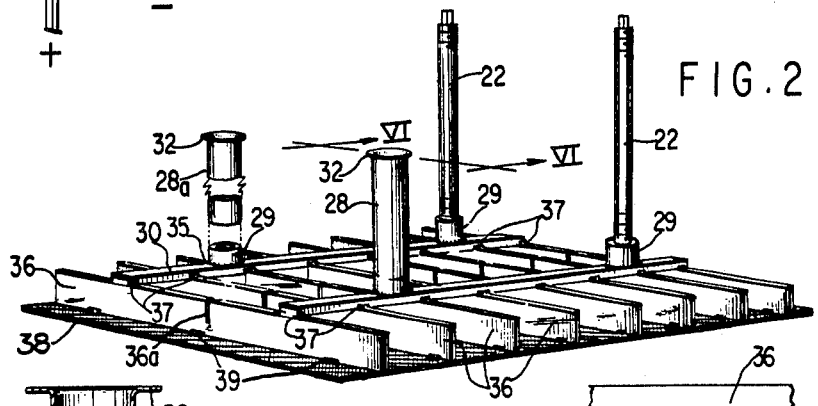
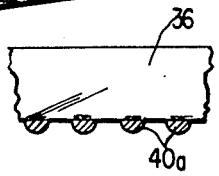
FIG. 9
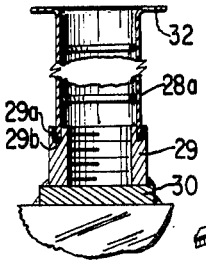
FIG. 10
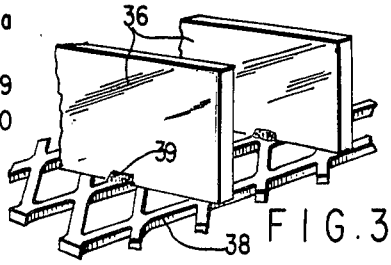
FIG. 3

FIG. 4
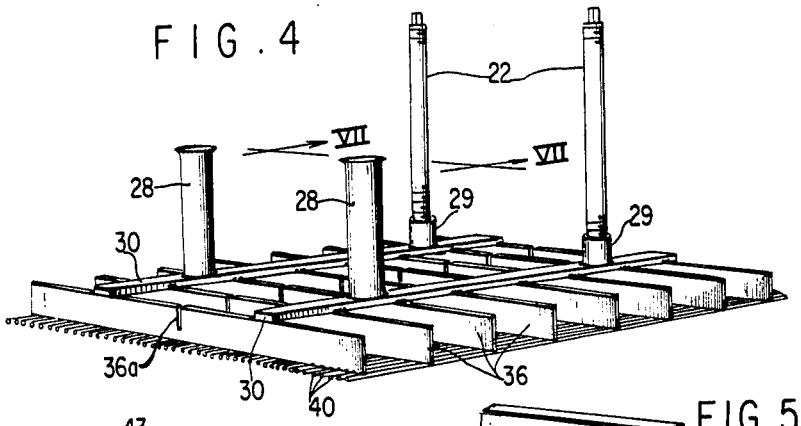
FIG. 5
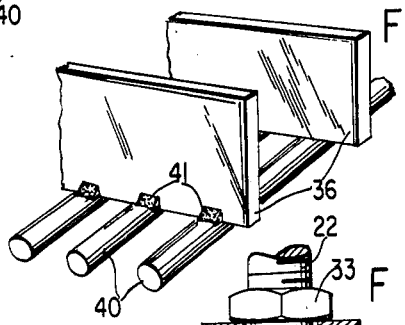
FIG. 8
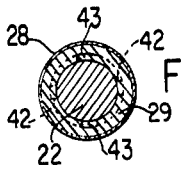
FIG. 6
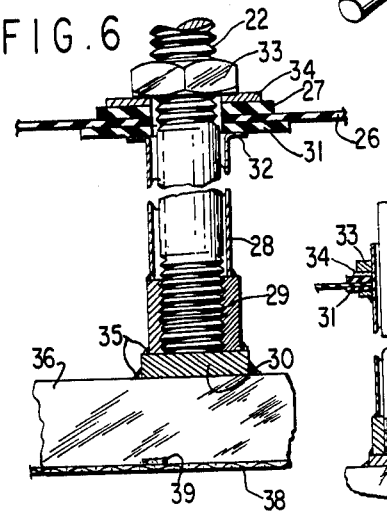
FIG. 7
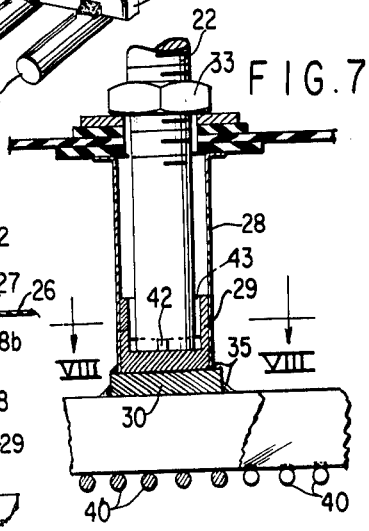
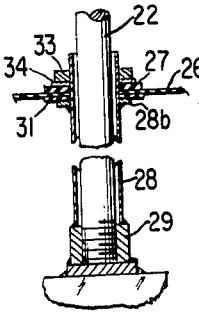
FIG. 11

FIG. 12
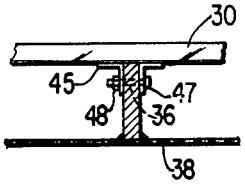
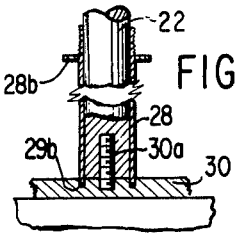
FIG. 11A
FIG. 14
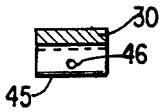
FIG. 13
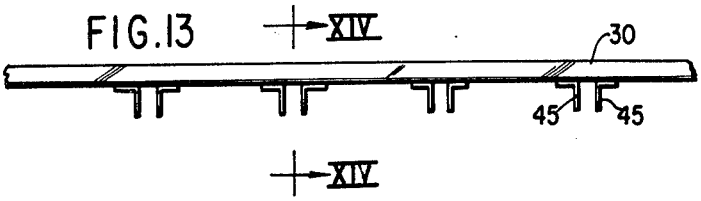
FIG. 15
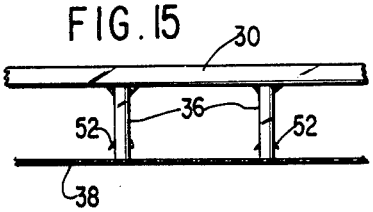
FIG. 16
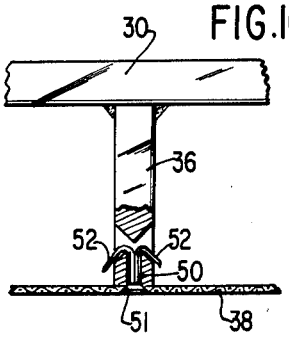
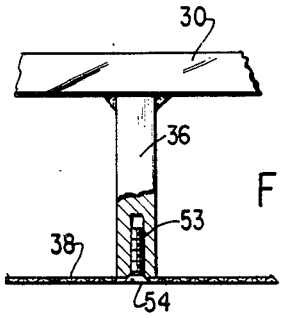
FIG. 17

ANODE STRUCTURE

PRIOR APPLICATION

This application is a continuation-in-part of copending application Ser. No. 836,256 filed June 25, 1969, now abandoned.

BACKGROUND OF THE INVENTION

The anodes of the present invention may be used for the electrolysis of sodium, potassium, lithium, cesium and ruthenium chlorides and bromides; for the electrolysis of barium and strontium chlorides and bromides; for the electrolysis of other salts which undergo decomposition under electrolysis conditions; for the electrolysis of HCl solutions, for the electrolysis of water and for other purposes. They may be used in mercury or diaphragm cells and may take other forms than those specifically illustrated. However, for the purposes of illustration, the use and construction of our improved anode for the electrolysis of sodium chloride brine to produce chlorine and sodium amalgam in a flowing mercury cathode cell will be described as one embodiment of our invention.

In the production of chlorine by the electrolysis of a brine solution, such as sodium chloride, in an electrolytic cell having an anode and a cathode, the previous most widely used material for anode construction was graphite because of its resistance to the brine and chlorine and other corrosive conditions encountered in an electrolysis cell and its ability to catalyze chlorine discharge from the anodes. Current is ordinarily supplied to the graphite anodes by a copper bus bar arrangement mounted exteriorly to the cell and suitable copper lead-in conductors carry the current to the graphite anodes. The surface of the anode facing the cathode is the working surface or face. Graphite, however, has the serious drawback of wearing poorly during the electrolytic process. Gap width variations, occasioned by wearing and spalling away of the graphite anode working surface, result in the need for additional current to maintain the requisite voltage to cause flow across the electrolytic gap, and the necessity of frequent adjustment or replacement of the graphite anodes. Moreover, the particles of graphite from the anodes collect in the amalgam or electrolyte and result in poor cell performance and additional expense to remove these impurities.

The disadvantages encountered in the use of graphite anodes have lead to attempts to provide dimensionally stable anodes by the use of metal anode structures resistant to electrolytic cell conditions. However, the use of dimensionally stable anodes has been accompanied by problems. The use of wear resistant metals (such as titanium and tantalum) to form dimensionally stable anodes, i.e., anodes with negligible wear and hence constant stability on the working surface under normal operating conditions, has resulted in the frequent occurrence of passivity when used in the brine solution under electrolysis conditions. Passivity results from the formation of a film on the active surface of the metal anode due to oxidization of same or to the inability to catalyze the formation of chlorine ($Cl_2$) from the chloride ions (Cl-) found at the anode surface. The film on the surface of the metal causes an increase in the electrical resistance of the anode which, in turn, requires that additional current be supplied to maintain flow of current in the electrolysis gap. Moreover, the selection of metal for use in anodes is severely restricted because of the high corrosive character of electrolysis cell conditions and the conductivity of such metals as titanium and tantalum is lower than the conductivity of copper.

The use of platinized titanium anodes which are formed of a titanium or titanium alloy base whose active or working surface is coated with platinum or other platinum group metal has not provided a satisfactory solution of the problems of dimensionally stable anode constructions. While wear, corrosion and passivation are reduced by the use of platinum plated titanium anodes, the cost is exceedingly high and numerous other disadvantages have been encountered. More particularly, peeling of the platinum face frequently occurs because metallurgical technology has not discovered a method of achieving a suitable, lasting bond between these two metals. Also, short circuiting in the electrolysis gap as occurs, for example, when ripples form in a mercury cathode surface, disintegrates the platinum layer, exposing the titanium or other base metal of the anode.

An additional problem encountered in the production of chlorine by the electrolysis of a brine solution with graphite anodes is the difficulty of obtaining and maintaining a uniform electrode gap having uniform voltage over the gap between the anode and the cathode. When graphite anodes are used the wear is ununiform, being greater at the hot end of the cell, a non-uniform gap width results, and the electrolytic process is inefficiently performed when the potential difference across the gap between the anode and cathode is not constant. Using a dimensionally stable anode assures that the gap dimension remains constant over the working life of the anode and definitely improves the cell performance.

The present invention overcomes the heretofore stated problems in the prior art of electrolytic production of chlorine and has as its primary object a dimensionally stable anode which effectively resists corrosive attack while resisting wear along the working surface to assure a uniform gap dimension over the entire width of the gap between the anode and cathode. Moreover, the present invention contemplates a cascade current distribution over the anode to achieve uniform electrical potential over the entire working surface of the anode.

One of the objects of our invention is to provide a dimensionally stable anode which will resist corrosion and other conditions within an electrolytic cell and which will insure uniform current distribution to the anode working surface.

Another object of our invention is to provide a dimensionally stable anode having means to protect the current lead-ins (usually of copper) while insuring uniform distribution of current to the anode working surface.

Another object of our invention is to provide a dimensionally stable anode with means for uniform distribution of current to the working face of the anode, which means will not interfere with discharge of gas bubbles from the working face of the anode.

Another object of our invention is to provide an anode structure in which lead-in protector sleeves are detachable from the anode primary conductor bars, so that the anode is convenient to ship and occupies little shipping space.

Another object of our invention is to provide an anode structure with which lead-in protector sleeves of different length may be used for cells of different height.

Another object of our invention is to provide an anode structure in which the electrolytically active valve metal anode face is removable from the conductors, so that it can be removed and recoated without requiring the conductors to be handled in the recoating operation.

Various other objects and advantages of our invention will appear as this description proceeds.

BRIEF DESCRIPTION OF THE DRAWINGS

The various advantageous features of the apparatus of the present invention will become apparent from the following detailed description and the accompanying drawings which relate to preferred embodiments of the invention and are given by way of illustration only.

FIG. 1 is a cross sectional view of a mercury electrolytic cell equipped with a flexible cell cover and dimensionally stable anodes of the present invention.

FIG. 2 is an isometric, partially exploded, view of one embodiment of the dimensionally stable anodes used in the cell of FIG. 1.

FIG. 3 is a detailed view of the mesh sheet in the anode of FIG. 2.

FIG. 4 is an isometric view of an alternate embodiment of the dimensionally stable anode of the present invention.

FIG. 5 is a detailed view of the working face of the embodiment of FIG. 4.

FIG. 6 is a detailed cross sectional view taken along the line VI — VI of FIG. 2, illustrating one connection of the lead-ins to the anode and the cell cover.

FIG. 7 is a detailed cross sectional view taken substantially along the line VII — VII of FIG. 4, illustrating another form of lead-in connection.

FIG. 8 is a cross sectional view taken along the line VIII — VIII of FIG. 7, which shows in detail one form of bayonet joint connection of the lead-ins to the primary conductor within the cell.

FIG. 9 is a modified form of rod face for the anodes.

FIG. 10 is a cross sectional view of the anode equipped with separate or detachable lead-in protector sleeves.

FIG. 11 is a cross sectional view of a modified form of protector sleeve.

FIG. 11A is a similar view of a further modification.

FIGS. 12, 13 and 14 are cross sectional views of a modified form of anode structure, in which the anode face is detachable from the primary conducting bars; and FIGS. 15, 16 and 17 are cross sectional views of a modified form of anode structure in which the anode face is detachable from the secondary conducting bars.

DETAILED DESCRIPTION OF THE INVENTION

In the preferred embodiment of the invention illustrated in FIG. 1, an electrolytic cell 10, of the type shown in U.S. Pat Nos. 2,958,635 or 3,042,602, comprises a continuously flowing mercury cathode which flows over the cell base 15 beneath stationary anodes **36*b*** immersed in a brine solution, such as sodium chloride. The approximate brine level is indicated by the line A — A. However, the brine level may be anywhere between the top of the anodes and the bottom of the cell cover, if a gas release space is provided. Electric current is supplied to the anodes and a return conductor connected to the cathode cell base sets up a potential difference across the gap between the anode and cathode which causes the chloride ions to migrate to the anode, and the sodium ions to migrate to the flowing mercury cathode, forming an amalgam which is conveyed out of the cell to a denuder (not shown). The chlorine gas, in bubbles, rises through the mesh openings in the anode to an outlet passage from the cell cover from which it flows to the chlorine recovery system.

The cell 10 is mounted between a pair of I-beams 11 and is inclined to cause the mercury to flow, by gravity, over the cell base 15. The cell comprises a bottom wall 12 and a pair of upstanding side walls 13, made of concrete, steel or other suitable rigid material. The side walls 13 are lined with a corrosive resistant insulating material 14, such as natural stone, or a coating of resin. The electrically conductive base 15, made of steel or the like, defines the inner bottom face of the cell. A conductor arrangement 16 secured to the undersurface of the bottom wall 12 includes spaced, upwardly projecting conductors (not shown) which contact the metal base 15, a conventional bus bar is connected to the conductor 16 to permit completion of the circuit. Conductors 16 form the negative connections to the circuit.

A plurality of spaced, transversely disposed pillars 17 span the cell above the I-beams 11 and are mounted on adjustable posts **17*a* which rest on and are releasably secured to the beams. The pillars 17 support a pair of longitudinally extending I-beams 18 on which is mounted on overlying elongated plate 19. Spaced along the plate 19 are suitable hook members 20** which are engaged by a conventional hoisting assembly (not shown) to remove the mounting structure overlying the cell when access to the interior, for repairs, is necessary.

A plurality of transversely extending braces 21 are secured to the bottom face of the I-beams 18 in a conventional manner, such as welding, and are used to support the anode structure in the cell. A plurality of downwardly projecting lead-ins 22, made of copper or other highly conductive metal, are spaced along the braces 21 and releasably secured to the latter in a conventional manner, as, for example, by threaded nuts on the conductor on either side of the brace. Bus bar connections 23 and 24, secured to a positive electric power source (not shown) convey current to the bus bars 25 which extend transversely of the cell and are secured to the lead-ins 22. A flexible cover member 26, such as is disclosed in the aforementioned U.S. Pat. No. 2,958,635, overlies the cell and is secured along its longitudinal edges to the walls 13. The cover includes spaced apertures which are aligned with and receive the downwardly projecting lead-ins 22. The flexible cover permits limited adjustment of the anodes without removal of the cover and relieves explosions, as explained below. All of this construction is more fully described in U.S. Pat. Nos. 2,958,635 and 3,042,602.

The anode assembly constituting the subject matter of this invention comprises a working face 38 or 40, comprising a titanium or tantalum mesh base covered with a conductor coating capable of catalyzing chloride ion discharge, such as a major portion of titanium dioxide ($TiO_2$) or tantalum pentoxide ($Ta_2O_5$) together with a minor amount of a doping composition, such as an oxide or a mixture of oxides of a platinum group metal capable of rendering the titanium dioxide semi-conductive and of catalyzing chloride ion discharge from the face of the anode. Other electrocatlytically active coatings such as electro-deposited or chemi-deposited platinum group metal coatings may be used but are not as desirable as the semi-conductive coating just described because of costs and inferior wear characteristics. The term "mesh" is intended to include thin sheets of titanium or tantalum or of alloys of titanium or tantalum in foraminous or expanded form, wire mesh and gauge, rolled wire mesh, punched and slotted sheet titanium or tantalum metal or alloys of titanium or tantalum, spaced rods or halfround forms, etc., and the words "titanium" and "tantalum" are intended to include alloys of these metals with other metals.

The working faces 38 or 40 are connected by welding, riveting or other connections, which may be permanent or separable connections, to a plurality of secondary conducting bars 36 and the bars 36 are connected to primary conducting bars 30 which, in turn, are connected to the copper lead-ins 22 by means of internally screw threaded titanium bosses 29, welded or otherwise secured to the primary conductor bars. Eight secondary conductor bars 36 and two primary conductor bars 30 have been shown but the number of primary and secondary conductor bars is not critical. They may be increased or decreased in number, but should be proportioned in size according to the conductive capacity of the metal to convey the required amount of current to the anode face and distribute it uniformly over the anode working face. The primary conductor bars 30 may sit on top of the secondary conductor bars 36 and be welded thereto or they may be notched into the bars 36 and welded thereto. The secondary and primary conductor bars are preferably arranged at right angles to each other for better current distribution but a slight deviation from a 90° connection is permissible.

As illustrated in FIG. 3, when expanded titanium mesh is used for the working face 38, the diamond-shaped openings in the mesh are longer in one direction than in the other and the secondary conducting bars 36 are preferably welded to the working face 38 at right angles to the long way of the diamond-shaped opening, while the primary conducting bars 30 run parallel to the long way of the diamond-shaped opening. This leads to better current distribution along the working face 38.

The bosses 29 are preferably internally screw threaded as shown in FIG. 6 to receive the screw threads at the bottom of the copper lead-ins 22. Titanium sleeves 28 surround the copper lead-ins 22 and extend from the bosses 29 to the cell cover 26 to protect the copper lead-ins from the corrosive effect of the electrolyte and the cell gasses. Other protective insulation, such as rubber, neoprene or other plastics which are resistant to electrolytic cell conditions, may be used in place of sleeves 28 to protect the lead-ins 22. The sleeves 28 may be welded to the bosses 29 as illustrated in FIG. 6, or may be separate from the bosses 29 as illustrated at **28*a* in the exploded left portion of FIG. 2 and in FIG. 10. The use of separate sleeves 28*a* permits the anode portions 29, 30, 36 and 38 or 40 to be assembled or welded together as a flat unit which occupies little space in shipping and allows the sleeves 28*a* to be shipped separately and assembled on the bosses 29 at the place of use. As chlorine cells of different height are used, the use of different height separate sleeves 28*a* permits the use of standard anodes, constituting portions 29, 30, 36 and 38 or 40, with different length separate sleeves 28*a*** for cells of different height.

When the sleeves **28*a* are separate from the bosses 29, they are sealed to the bosses with a fluid tight seal formed by a circular groove 29*a* formed in the top of bosses 29 and surrounding the lead-in opening and a neoprene or similar ring 29*b* which fits into the bottom of the circular groove 29*a*. When the bottom of the sleeve 28*a* is pressed against the ring 29*b***, a fluid tight seal is formed.

In the assembled structure, the liquid and gas-proof titanium tubes 28 surround and protect the copper lead-ins 22 from the corrosive conditions inside the cell. The flanges 32 on the tubes 28 rest against a gasket 31 which is sealed against the cell cover 26 by gaskets 27, washer 34 and nut 33 screwed on the lead-ins 22.

In the embodiment illustrated in FIGS. 7 and 8, the bosses 29 and the lead-ins 22 are formed to provide a bayonet lock joint in which lugs 42 on the lead-ins slide into slots 43 in the bosses and can be turned into a circular engagement in the base of the bosses 29 to lock the lead-ins into the bosses. The circular enlargement or the lugs 42 are provided with cammed surfaces to insure a tight lock.

In the embodiments illustrated in FIGS. 1, 2 and 4, the bosses 29 are shown to be welded to parallel, longitudinally extending primary conductors 30 at symmetrically spaced points 35. In these embodiments, four sleeves 28 are provided in the anode assembly, spaced laterally in pairs and secured to or mounted on a pair of longitudinally extending primary conductors 30. It will be apparent, however, that only a single longitudinal conductor bar 30 may be used having one or more bosses and sleeves, depending on cell size and anode weight considerations. Also, more than two primary conductors 30 and bosses 29 and sleeves 28 may be used in the anode construction depending on these same considerations.

The secondary crossbar conductors 36 extend laterally of the cell and are welded at spaced intervals 37 to the longitudinal primary conductors 30. Secured to the bottom edge of crossbars 36 is a sheet of titanium mesh 38 or rods 40 which conduct current to the electrode gap and allow the passage of chlorine bubbles therethrough as the chloride ions migrate to the anodes and are catalyzed to $Cl_2$ during electrolysis. The titanium mesh 38 or rods 40 may be either removably or permanently secured to the crossbars 36 by welding, riveting or by screws or otherwise. Better electrical connections are secured by welding.

In the embodiment of FIG. 2, a foraminous titanium mesh screen 38 is welded to the crossbars 36. The screen may be active on its entire surface or only on one side. The crossbars 36 are welded to the sheet substantially throughout their length and contact the screen over their entire length to insure effective distribution of current over the entire anode working surface and effective levelling of the anode face. Notches **36*a* at approximately the midpoint of crossbars 36** serve to relieve welding strains and permit minor adjustments of the working faces of the anodes for levelling purposes.

In the embodiment of FIGS. 4 and 5, the anode face is comprised of a plurality of closely spaced parallel rods 40 secured individually to the crossbars 36. As in the case of the embodiment of FIG. 2, current conveyed through the crossbars 36 is equally distributed to the anode working surface.

In the embodiment of FIG. 9, the rods **40*a* are half-round bars. The rods 40 or 40*a*** may be round, rectangular, half-round, oval, serpentine or any other desired shape and may be connected together to form a continuous circular, oval or serpentine face on the anode.

In the embodiment of FIG. 11, the sleeves 28 are provided with intermediate flanges **28*b* against which gaskets 31 rest, to seal the cell cover 26 over the sleeves 28 by means of gaskets 27, washers 34, and nuts 33 screwed on the sleeves 28. In this embodiment, the open top of sleeves 28 extends above the cover 26 and sleeves 28 may be kept filled with water or other cooling or heat transfer medium to cool the joint between the lead-ins 22 and the bosses 29**.

The lead-ins 22 are preferably screwed down tight against the conductor bars 30 as illustrated in FIG. 6, so as to convey current not only through the bosses 29 to the conductors 30 but also by the contact between the ends of lead-ins 22 and conductor bars 30. Any space between lead-ins 22 and bosses 29 may be filled with a low melting alloy—such as Wood's alloy—which remains liquid at the cell temperature and provides a liquid conductor contact between the lead-ins and the conductor bars 30.

FIG. 11A illustrates a further embodiment of the lead-in connections in which the lead-ins 22 are screwed down tightly against the conductor bars 30 by the use of connecting titanium stud bolt 30*a* which is connected by screw threads with both the lead-ins 22 and the conductor bars 30.

FIGS. 12, 13 and 14 show an embodiment of the anode in which the mesh face 38 and secondary conducting bars 36 are detachably connected to the primary conducting bars 30 by means of right angle brackets 45 secured at spaced intervals to the primary conductors 30. Each bracket 45 is provided with holes 46 and the secondary conductor bars 36 are provided with corresponding holes so that bolts 47 may be inserted through the holes and secured by nuts 48 to draw the downwardly projecting legs of brackets 45 into tight electrical contact with cross bars 36. The nuts 48 and bolts 47 may, however, be removed and the secondary conductor bars 36 and attached mesh face 38 detached from the primary conductor bars 30 whenever the mesh face 38 needs to be recoated, replated or repaired. FIG. 14 is a sectional view along the line XIV — XIV of FIG. 13.

In the embodiment illustrated in FIGS. 15, 16 and 17, the secondary conductor bars 36 are permanently secured to the primary conductor bars 30 and the mesh face 38 is removably connected to the secondary conductor bars 36 by means of riveted or screw threaded connections. In FIGS. 15 and 16, the secondary conductor bars 36 are provided with a series of Y-shaped holes 50 into which split rivets 51 are driven and the projecting ends of the rivets bent over the sides of the secondary conductors 36 as shown at 52. A plurality of these connections are made along each secondary conductor 36. The heads of rivets 51 are countersunk into the holes 50 so that the rivet heads do not protrude beyond the face of the mesh 38. When the mesh 38 is to be detached from the secondary conductor bars 36, the projecting ends 52 of rivets 51 are cut off and the rivets 51 withdrawn.

In FIG. 17, countersunk screw threaded holes 53 are provided in the secondary conductor bars 36 and screws 54 inserted through the mesh to detachably secure the mesh on the secondary conductor bars. The same type of connection may be used to detachably connect rods 40 to secondary conductor bars 36.

Before or after the anode has been assembled as described, the front and back of the working face are given a conducting coating capable of catalyzing chlorine discharge from the working face. Any suitable coating may be used. Coatings of the type described in copending application Ser. No. 771,665, filed Oct. 29, 1968, may be used, but any other coating capable of providing the working face with a coating which will continue to conduct current to the electrolyte without becoming passivated and catalyze chlorine discharge may be used, such as electro-deposited or chemi-deposited coatings of platinum group metals (i.e., platinum, ruthenium, iridium, rhodium, etc.) or mixtures thereof.

One such coating may be provided as follows:

EXAMPLE I

Before or after the anode as illustrated and described in connection with FIG. 2 has been assembled, the anode face is cleaned by boiling at reflux temperature of 110° C. in a 20% solution of hydrochloric acid for 40 minutes. It is dried and then given a liquid coating containing the following materials in the proportions given:

| | |
|---|---|
| Ruthenium as $RuCl_3 . H_2O$ | 10 mg (metal) |
| Iridium as $(NH_4)_2IrCl_6$ | 10 mg (metal) |
| Titanium as $TiCl_3$ | 56 mg (metal) |
| Formamide ($HCONH_2$) | 10 to 12 drops |
| Hydrogen peroxide ($H_2O_2$ 30%) | 3 to 4 drops |

per 50 square centimeters of anode face.

The coating is prepared by first blending or mixing the ruthenium and iridium salts containing the required amount of Ru and Ir in a 2 molar solution of hydrochloric acid (5 ml are sufficient for the above amounts) and allowing the mixture to dry at a temperature not higher than 50° C. until a dry precipitate is formed. Formamide is then added to the dry salt mixture at about 40° C. to dissolve the mixture. The titanium chloride, $TiCl_3$, dissolved in hydrochloric acid (15% strength commercial solution), is added to the dissolved Ru-Ir salt mixture and a quantity of hydrogen peroxide (30% $H_2O_2$, about 16–22 milliliters) is added, sufficient to make the solution turn from the blue color of the commercial solution of $TiCl_3$, to a brown-reddish color.

The coating mixture, then prepared, is applied to both sides of the cleaned titanium anode base and to the sides of the interstices in the mesh, by brush, in eight subsequent layers so that the coating surrounds the mesh. After applying each layer, the anode base is heated in an oven under forced air circulation at a temperature between 300° and 350° C. for 10 to 15 minutes, followed by fast natural cooling in air between each of the first seven layers, and after the eighth layer is applied the anode is heated at 450° C. for one hour under forced air circulation and then cooled. This provides a ceramic type semi-conducting coating on the anode face.

The amounts of the three metals in the coating correspond to the weight ratios of 13.15% Ir, 13.15% Ru and 73.7% Ti and the amount of noble metal in the coating corresponds to 0.2 mg Ir and 0.2 mg Ru per square centimeter of projected electrode area. It is believed that although the three metals in the coating mixture were originally present as chlorides they are co-deposited on the titanium base in other forms. Stoichiometric determinations indicate that in the final coating the iridium chloride is reduced to $IrO_2$, whereas ruthenium chloride and titanium chloride are converted into ruthenium oxide $RuO_2$ and titanium oxide and the mixed oxides form semi-conductors by solid solution. In place of ruthenium, any platinum group metal may be used and in place of titanium, tantalum or alloys thereof, other valve metals and alloys may be used in the above formulation. If a platinum group metal coating is used on the mesh face, it may be applied by electro-deposition or by chemi-deposition either before or after the mesh face 38 is secured on the secondary conductors 36.

The location of secondary conductors 36 and of the boses 29 and sleeves 28 on top of primary conductors 30, permits chlorine bubbles to escape freely from the working surface of the anodes and prevents gas blanketing. As an illustration of the relative proportions of the primary and secondary conductors to the anode face, in an anode having a working face of 27×31 inches and a mesh 0.060 inches thickness, designed to work at a current density of 7 amperes per square inch and having four lead-ins, two primary conductors and eight secondary conductors (crossbars), the titanium primary conductors should be approximately 0.375 in. × 1.75 in. = 0.655 sq.in. and 29 in. long, and the secondary conductors 0.125 in. × 1.600 in. = 0.200 sq. in. and 27 in. long. The relative proportions will, however, change if any of the anode dimensions are changed and the mesh thickness may also be changed. The anodes may be larger or smaller than the dimensions given, but the relative proportions should be of the order given above.

OPERATION

In operation, current is supplied via the conductors 23 and 24 from the electric power source to the bus bar 25. Equal amounts of current are distributed to the conductors 22 which pass the same to each of the primary conductors 30. The current then flows along the primary conductors bidirectionally, i.e., current flows equally in both directions, along the primary conductors 30 and thus longitudinally of the anode face 38. The current is then redispersed equally along the secondary conductors or crossbars 36 and transversely of the mesh working face secured to the bottom edges of the crossbars 36. Since the conductors are symmetrically spaced and the primary conductors and secondary conductors are secured in tiers at two levels and lie in an axis substantially at right angles to one another, current is distributed in a cascade fashion which insures equal distribution over the working face of the anode. Consequently, a uniform potential difference across the entire electrode gas is secured so that as the brine solution passes through the gap between the anode and cathode, the electrolytic process is performed uniformly throughout the entire length and width of the gap and chlorine bubbles flow upwardly through the mesh sheet to the outlet passage provided in the cell cover for the collection of chlorine. The anode thus imparts a uniform potential difference over the entire electrode gap to maximize the liberation of chlorine. As the anode mesh 38 - 40 is relatively thin (compared to a graphite anode) and is provided in one of the illustrations given, with a conductive coating on both its top and bottom surface, it will conduct current to the electrolyte from both the top and bottom faces and will produce chlorine on both faces so that the effective anode area is greater than a graphite anode with a corresponding square area.

The primary conductors 30 and secondary conductors 36 form a reinforcing frame for the titanium mesh anode faces which prevent deformation of the thin anode face during heating to bake a semi-conductive coating on the anode mesh faces and give support and reinforcement to the anode face during shipment and handling for assembly into the cells.

Electrodes of the type described herein produce arcing if a temporary short circuit occurs between an anode and the flowing mercury cathode. This causes minor explosions or popping. The use of a flexible cell cover 26 relieves the pressure caused by these explosions or pops without rupturing the cell cover. Large explosions may cause ruptures of the cell cover which can be repaired by applying a plastic patch over the rupture.

Data taken from experimental tests utilizing the embodiments of the present invention indicate a substantial savings in the electrolytic reduction of the sodium chloride into chlorine and sodium.

The words "titanium" and "tantalum" are intended to include also alloys of these metals and the word "welding" is intended to include other equivalent methods of connecting metal parts such as riveting, screw threading the parts together, etc.

Although only a limited number of embodiments of the present invention have been illustrated and described, it will be evident to those ordinarily skilled in the art that various modifications and changes may be made from those shown without departing from the principles of the invention. What is claimed is:

1. An anode for use in a horizontal electrolysis cell having a base, sides and a cell cover, a substantially horizontal cathode in said cell and a substantially horizontal valve metal anode in said cell opposite said cathode, said anode having a valve metal working face comprising an open mesh structure having an electric conducting electrocatalytic coating thereon, valve metal secondary conducting bars connected at their narrow edges to said working face and extending transversely of said working face, notches in said secondary conducting bars to permit relative movement of one part of said anode working face relative to the other parts, valve metal primary conducting bars connected to said secondary conducting bars at substantially right angles to said secondary conducting bars, said secondary conducting bars spacing said primary conductors from said working face, highly conductive, non valve metal lead-in conductors, means to detachably connect and reconnect said lead-in conductors directly to said primary conducting bars in firm contact therewith, liquid and gas-proof valve metal protective sleeves surrounding and spaced from said lead-in conductors, said sleeves extending between said primary conductors and said cell cover inside said cell, said means for connecting and disconnecting said lead-in conductors to said primary conductors being inside said sleeves, whereby said lead-in conductors can be connected to and disconnected from said primary conductors inside said sleeves.

2. The anode of claim 1, in which said working face, said secondary conducting bars, said primary conducting bars and said protective sleeves are made of titanium and are welded together, and said lead-in conductors are of a material of higher conductivity than titanium.

3. The anode of claim 1, in which said protective sleeves are separate from said primary conducting bars and have a flange making a liquid and gas-proof seal with said cell cover and a base making a liquid-proof seal with said primary conducting bars.

4. The anode of claim 1, in which the lead-in conductors abut tightly against the primary conductor bars to conduct current thereto.

5. An anode for use in a flowing mercury cathode chlorine cell having a base, sides and a cell cover, said anode comprising lead-in conductors, an anode working face having a foraminate structure, primary conducting bars detachably connected to said lead-in conductors and extending longitudinally of the anode working face, said lead-in conductors abutting against said primary conducting bars, and secondary conducting bars extending transversely of the anode working face inside the cell, said secondary conducting bars extending substantially at right angles to said primary conducting bars, and being connected thereto, the anode face being spaced from the primary conducting bars by the secondary conducting bars, said primary and secondary conducting bars and said anode working face being constructed of the same metal and integrally connected together, said secondary conducting bars being notched to permit relative movement of one part of the anode face relative to the other.

6. The anode of claim 5, in which the anode working face and the primary and secondary conducting bars are titanium and liquid and gas-proof titanium sleeves surround the lead-in conductors inside the cell and are spaced therefrom and extend between the primary conducting bars and the cell cover.

7. The anode of claim 5 in which the anode working face is formed of spaced rods.

8. The anode of claim 5 in which the sleeves are separate from the primary conducting bars and have a flange making a liquid and gas-proof seal with the cell cover and a base making a liquid-proof seal with the primary conducting bars.

* * * * *